US006250293B1

(12) United States Patent
Andrews

(10) Patent No.: US 6,250,293 B1
(45) Date of Patent: Jun. 26, 2001

(54) ADJUSTABLE ARCHERY BOW CAM

(75) Inventor: Albert A. Andrews, Cleveland, TN (US)

(73) Assignee: High Country Archery, Dunlap, TN (US)

( * ) Notice: Subject to any disclaimer, the term of this patent is extended or adjusted under 35 U.S.C. 154(b) by 0 days.

(21) Appl. No.: 09/578,628

(22) Filed: May 25, 2000

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS

| | | | |
|---|---|---|---|
| 3,987,777 | 10/1976 | Darlington | 124/25.6 |
| 4,079,723 | 3/1978 | Darlington | 124/25.6 |
| 4,124,014 | 11/1978 | Darlington | 124/88 |
| 4,195,616 | 4/1980 | Darlington | 124/25.7 |
| 4,338,910 | 7/1982 | Darlington | 124/25.6 |
| 4,519,374 | 5/1985 | Miller | 124/25.6 |
| 4,524,750 | 6/1985 | Darlington | 124/25.6 |
| 4,756,296 | 7/1988 | Darlington | 124/25.6 |
| 4,774,927 | 10/1988 | Larson | 124/25.6 |
| 4,838,236 | 6/1989 | Kudlacek | 124/25.6 |
| 4,926,832 | 5/1990 | Darlington | 124/25.6 |
| 4,926,833 | 5/1990 | Darlington | 124/23.1 |
| 4,967,721 | 11/1990 | Larson | 124/25.6 |
| 4,976,250 | 12/1990 | Jeffrey | 124/25 |
| 4,986,250 | 1/1991 | Darlington | 124/25.6 |
| 5,092,309 | 3/1992 | Beaton | 124/35.2 |
| 5,301,651 | 4/1994 | LaBorde et al. | 124/25.6 |
| 5,368,006 | 11/1994 | McPherson | 124/25.6 |
| 5,433,792 | 7/1995 | Darlington | 124/25.6 |
| 5,505,185 | 4/1996 | Miller | 124/25.6 |
| 5,649,522 | 7/1997 | Troncoso | 124/25.6 |
| 5,678,529 | 10/1997 | Larson | 124/25.6 |
| 5,884,614 | 3/1999 | Darlington et al. | 124/25 |
| 5,934,265 | 8/1999 | Darlington | 124/25.6 |
| 6,082,347 * | 7/2000 | Darlington | 124/25.6 |
| 6,112,732 * | 9/2000 | Larson | 124/25.6 |

* cited by examiner

*Primary Examiner*—John A. Ricci
(74) *Attorney, Agent, or Firm*—Warn, Burgess & Hoffman, PC

(57) ABSTRACT

A cam for a compound archery bow has an adjustable draw cam and a draw stop arm, each releasably and adjustably carried by the cam to permit rapid adjustment of the draw length and let-off characteristics of the cam without having to completely disassemble the bow and without having to replace either of the adjustable draw cam or draw stop arm with different components. Therefore, a plurality of draw lengths as well as let-offs may be achieved by the consumer without having to completely disassemble the bow or purchase a plurality of different, specialized parts. Advantageously, the number of different parts which need to be produced to provide a wide range of draw lengths and let-offs is drastically reduced to greatly facilitate the economical manufacture of cams for archery bows.

44 Claims, 7 Drawing Sheets

ADJUSTABLE ARCHERY BOW CAM

BACKGROUND OF THE INVENTION

1. Field of the Invention

This invention relates generally to archery bows and, more particularly, to an adjustable cam for an archery bow.

2. Description of the Related Art

Compound archery bows are well known and may utilize one or more cams to more efficiently store energy in the bow limbs as a drawstring of the bow is drawn. Additionally, a compound bow provides a let-off or reduction of the force required to pull the drawstring during a portion of the draw, and may be adapted to limit the maximum draw length of the bow. Both improve the performance and ease of use of the bow. Compound bows may utilize a single cam and an idler wheel on opposed limbs of the bow or a pair of cams, one at the free end of each limb of the bow.

Some archery bows utilize one-piece unitary cams that have one or more grooves formed therein to receive the strings of the bow and one or more posts to which the free end of a bowstring may be attached. To change the characteristics of the bow, such as the draw length, location in the draw and intensity of the let-off of the draw, the user of the bow must completely disassemble the bow and replace the existing cams with replacement cams having different characteristics. Notably, the bow must be disassembled with the use of a bow press to safely remove the bowstring from the limbs which are all under tension. After changing, the cams, the bow must be reassembled and readjusted to enable and optimize its use with the new cams. Further, the new cams are just as inflexible as the old cams in that they have fixed characteristics that cannot be readily altered by a user. Thus, the one-piece cams are very limited, difficult and expensive to change, and very costly to manufacture as several distinct cams must be manufactured for the various draw lengths and let-offs desired by consumers.

So-called modular cams have also been used on archery bows. These modular cams have a one-piece main body as in prior cams, and a plurality of individual modules which can be mounted one at a time onto the cam body with each having a different shape and hence, different characteristics in use. Each individual module is distinct from one another and may be individually fixed to the cam in a single location to provide the desired characteristics to the cam and hence the archery bow. For example, modules having different profiles or contours may be placed on a cam to change the intensity of the let-off, which is usually stated as a percent of the draw weight, or the location in the draw where the let-off is initiated. Thus, to vary the let-off within a range of intensity of let-offs, a plurality of independent and distinct modules must be used.

Additionally, to limit the draw length of the bow, some cams have been adapted to receive "draw stops" which engage either a string or a limb of the bow at the maximum draw length of the bow to prevent the bow from being overdrawn. Conventional draw stops are typically small knobs attached to the cam by a screw. Such draw stops may vibrate loose from the cam and be lost during use. Still further, the engagement of the small knob with the limb or a bowstring provides a very abrupt stop and a "jerky," unsmooth feel to the bow that is undesirable to consumers. Still further, movement of the draw stop relative to the cam, or to a module on the cam, can undesirably change the performance, efficiency and accuracy of the bow. An incorrectly placed draw stop can reduce the efficiency of the bow, cause a loss in accuracy of an arrow shot from the bow and result in a decrease in speed of an arrow shot from the bow.

SUMMARY OF THE INVENTION

Accordingly, the present invention relates to a cam for a compound archery bow. The cam may include an adjustable draw cam and a draw stop arm each releasably and adjustably carried by the cam to permit rapid adjustment of the draw length and let-off characteristics of the cam without having to completely disassemble the bow, i.e., without having to replace either of the adjustable draw cam or draw stop arm with different components. Therefore, a plurality of draw lengths as well as let-offs may be achieved by the consumer without having to completely disassemble the bow or purchase a plurality of different, specialized parts. Advantageously, the number of different parts needed to produce a wide range of draw lengths and let-offs is drastically reduced to greatly facilitate the economical manufacture of cams for archery bows.

Preferably, the draw stop arm is an elongated arm releasably carried by the cam. The draw stop arm engages a bowstring during at least a portion of the rotation of the cam during the draw of the bow, and is movable between a plurality of positions to alter its engagement with the bowstring. Repositioning the draw stop arm affects the draw length and magnitude of the let-off of the bow. The draw stop arm may include an elongated track or groove therein that receives the bowstring at the end of the draw. Preferably, as the bowstring is drawn, it increasingly engages the draw stop arm to provide a softer or more controlled limit to the draw length of the bow. If desired, the groove or track in the arm may have a radius or may be generally arcuate to further control engagement of the bowstring with the arm to provide an improved feel to the user. The draw stop arm may be of substantially any shape and may even comprise more than one piece so long as at the maximum draw length of the bow the string of the bow is engaged by the draw stop over a distance of at least ¼ of an inch and preferably ½ of an inch or more.

In the preferred embodiment, the arm is pivotally carried at one end on the cam for pivotal movement about an axle that mounts the cam on the limb of the bow with the other end of the arm movable and releasably securable to the cam in a plurality of positions. Desirably, each position relates to a specific increment of draw length ranging from 1/16 of an inch up to 1 inch or more as desired. This provides tremendous flexibility to the user of the bow by enabling them to choose between a wide range of draw lengths and let-offs without having to disassemble the bow.

The adjustable draw cam is also releasably carried by the cam. The adjustable draw cam engages the bowstring during the draw of the bow and is movable between a plurality of positions on the cam to vary the draw length of the bow and the locations of and optionally, the intensity of the let-off. The adjustable draw cam may include a track or groove that receives the bowstring. Preferably, the adjustable draw cam includes a comer or radius around which the bowstring is wrapped as the cam rotates during the draw of the bow. A portion of the corner or radius extends generally tangentially to the axle of the cam and defines the point on the cam wherein the let-off begins and which may be referred to as a "break over radius." After the bowstring engages and wraps around this corner or break over radius, the let-off is initiated to reduce the force needed to pull the drawstring further or to hold the drawstring. The adjustable draw cam may be generally circular and may be axially or eccentrically mounted on the cam. Alternatively, the draw cam may have an irregular shape contoured to maximize the performance and versatility of the bow. By changing the position of the same adjustable draw cam relative to the cam, the position of the break over radius is changed, thereby changing the location at which the let-off is initiated and, in part, the draw length of the bow.

Desirably, both the draw stop arm and draw cam are independently movable between a plurality of positions to greatly increase the flexibility of the bow by enabling a consumer to rapidly and easily change the draw length and let-off characteristics. Advantageously, a single cam with a draw stop arm and a draw cam may be used in place of a plurality of one-piece cams or a plurality of differently shaped modules. This greatly simplifies and decreases the number of parts required to provide a wide range of draw lengths and let-off characteristics for a particular bow.

Objects, features and advantages of this invention include providing a bow with an adjustable cam that greatly increases the flexibility of the bow, enables an end user to rapidly and easily change the draw length and let-off characteristics of the bow, enables the draw length and let-off characteristics of the bow to be changed without disassembling the bow, greatly reduces the number of parts needed to provide a wide range of draw lengths and let-off characteristics of the bow, drastically reduces the production costs of the bow, provides a controlled and efficient limit to the draw length of the bow, provides repeatable performance of the bow, enables efficient storage and release of energy from the bow at a wide range of draw lengths, is of relatively simple design and economical manufacture and assembly, durable, reliable and has a long, useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
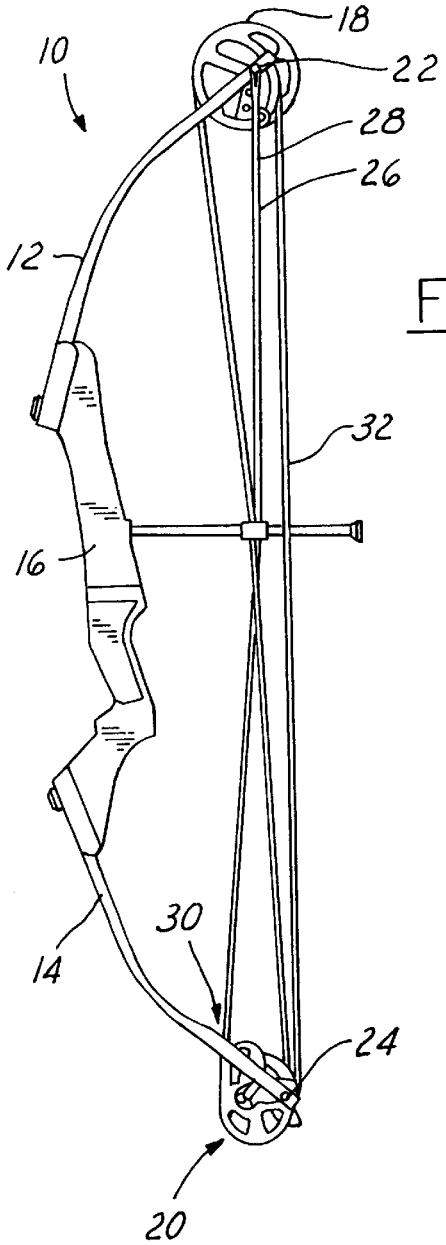
FIG. 1 is a side view of a single cam compound archery bow having a cam embodying the present invention.

Referring in more detail to the drawings, FIG. 1 illustrates an archery bow 10 which has a pair of flexible limbs 12, 14 each fixed at one end to a separate end of a riser or handle 16 with an idler wheel 18 at the free end of one limb 12 and a earn 20 at the free end of the other limb 14. Separate axles 22, 24 extending through their respective limbs 12, 14, carry the cam 20 and idler wheel 18. A harness string 26 is split at one end with each split end 28 (only one shown) fixed to the limb 12 on opposed sides of the idler wheel 18 and its other end 30 releasably attached to the cam 20. A drawstring 32 has both its ends releasably attached to the cam 20 and interconnects the idler wheel 18 and cam 20. Upon drawing or pulling back the drawstring 32, energy is stored in the limbs 12, 14 of the bow 10. The stored energy is released upon release of the drawstring 32 permitting the bow 10 to return to its at rest position as shown in FIG. 1. Alternative string arrangements are possible with some bows utilizing more or less than two strings. As used herein, the term "bowstring" denotes any string of a bow such as the harness string 26, drawstring 32 or other, as appropriate.

Figure 2:
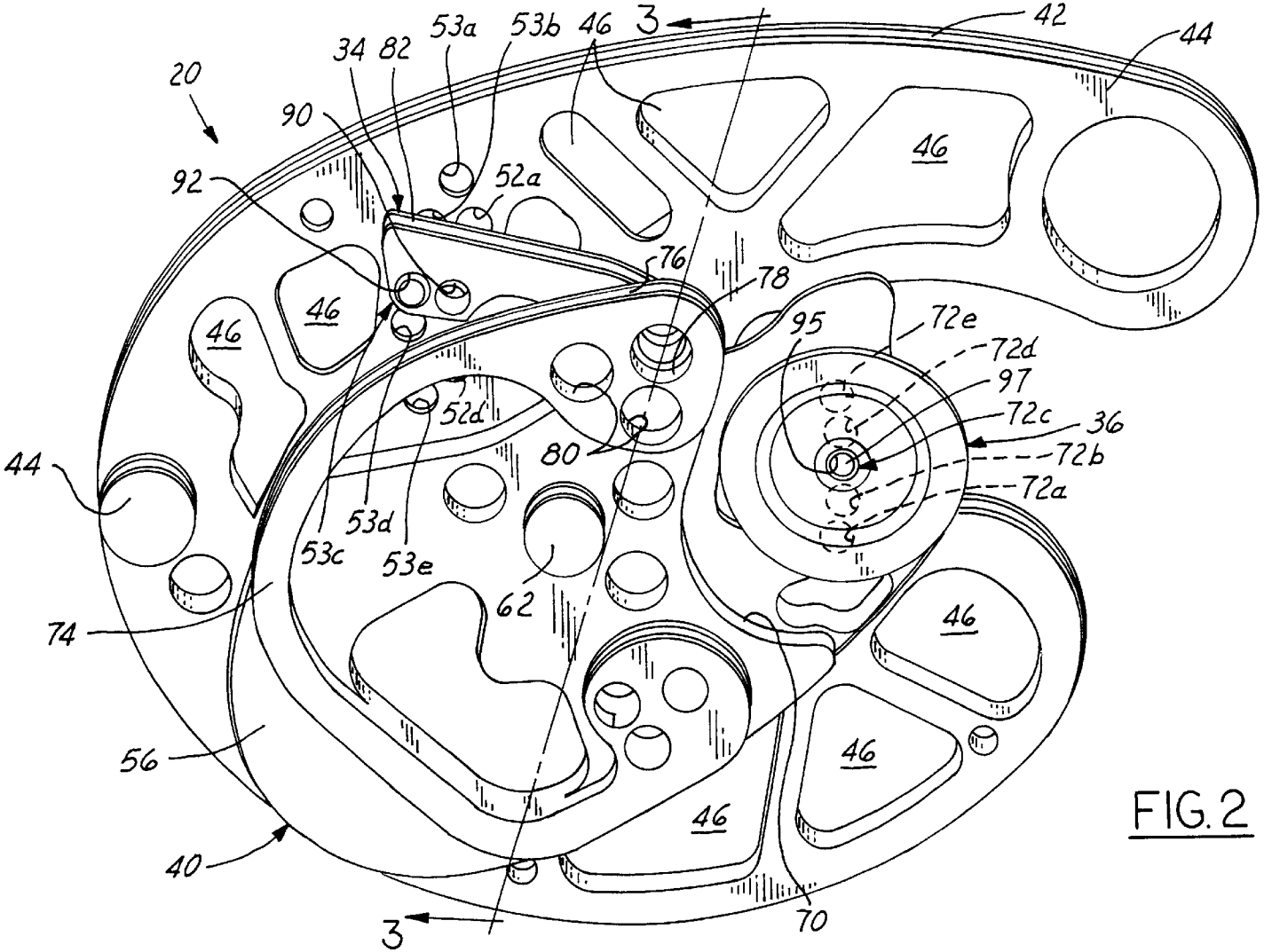
FIG. 2 is a perspective view of the cam of the archery bow.
Figure 7:
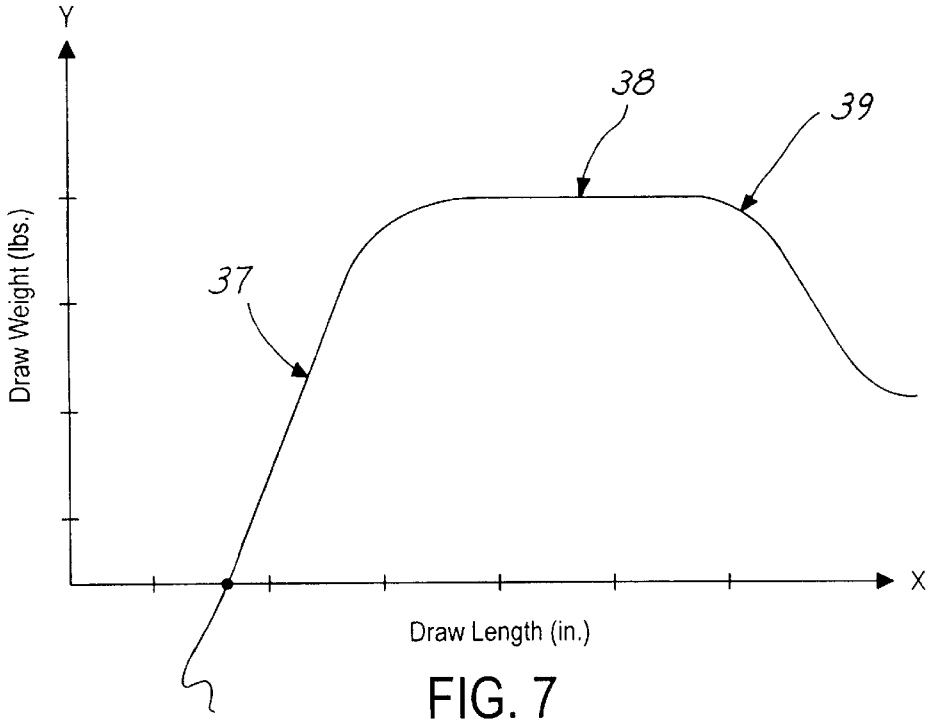
FIG. 7 is a representative graph of draw weight or force versus draw length for a compound archery bow.

As shown in FIG. 2, to permit the draw length and let-off characteristics of the bow 10 to be changed by a user, the cam 20 releasably and adjustably carries a draw stop arm 34 and an adjustable draw cam 36. As shown in the drawings, the cam 20 is contoured to interact with the harness string 26 and drawstring 32 and thereby store energy in the bow limbs 12, 14 in a predetermined manner. As shown in FIG. 7, there is a generally linearly increasing force over a first portion 37 of the draw length, thereafter providing a controlled dwell 38 wherein an essentially constant force is needed to pull the drawstring 32 further for a second duration of the draw, and finally reaching a let off point 39 wherein the force needed to further draw the bow 10 is reduced until the maximum draw length is achieved. Let-off is desirable to reduce the force needed to fully draw the bow 10 and to facilitate holding and aiming the fully drawn bow 10. The bow 10, as shown with an idler wheel 18 and one cam 20, is known as a single cam bow. However, the invention is also applicable to archery bows having two cams 20 and no idler wheel 18.

Figure 3:
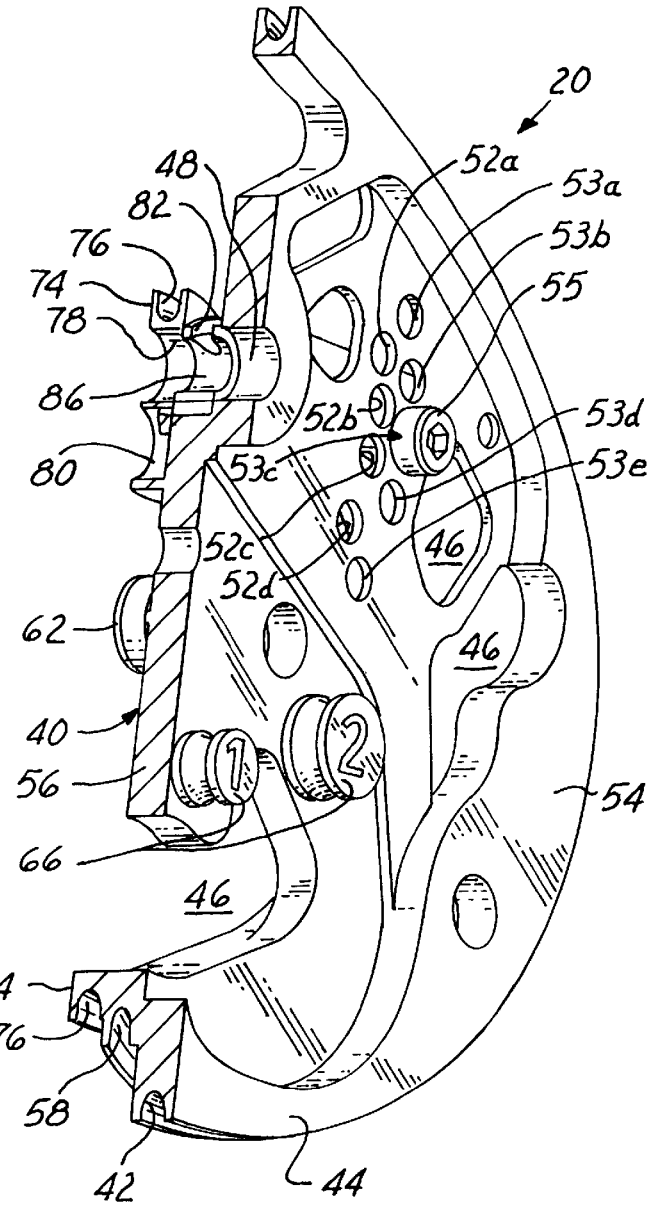
FIG. 3 is a sectional view of the cam of FIG. 2 also taken generally along lines 3—3 illustrating a rear face of the cam.
Figure 4:
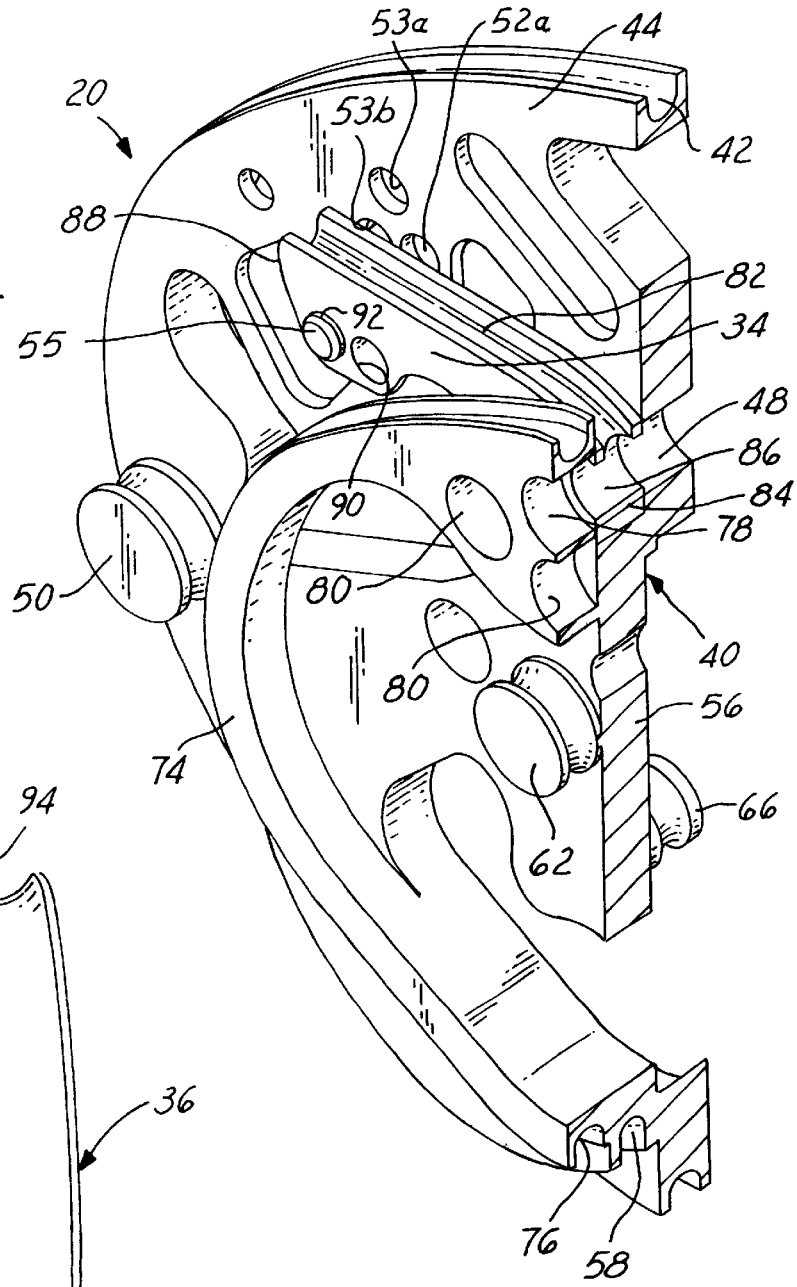
FIG. 4 is a sectional view of the cam taken generally along lines 3—3 of FIG. 2 illustrating a front face of the cam.

As shown in FIGS. 2–4, the cam 20 preferably has a one-piece cam body 40 defining three separate and spaced apart tracks or channels in which portions of the harness string 26 and drawstring 32 arc received. A first track 42 is formed in the periphery of a first cam portion 44 of the cam body 40 and is constructed to receive a portion of the drawstring 32 of the bow 10. Initially, the drawstring 32 is trained around the first cam portion 44 of the cam body 40 in the first track 42 when the bow 10 is in its at rest position. Upon drawing the bow 10, the cam 20 rotates about its axle 24 and the drawstring 32 is unwrapped or increasingly removed from the first track 42 to permit the drawstring 32 to be pulled away from the handle 16 and limbs 12, 14 as the bow 10 is drawn. Various sections 46 of the first cam portion 44 may be cut out to reduce the weight of the cam 20. An opening 48 through the first cam portion 44 receives the axle 24 mounting the cam 20 to the limb 14. At least one circular anchor or hook-up post 50 with a circumferential groove is provided on the first cam portion 44 to retain one end of the harness string 26. A plurality of hook-up posts 50 may be provided wherein the hook-up posts 50 are spaced from one another to change the location of the harness string 26 end which changes the effective length of the harness string 26 and affects the initial loading of the limbs 12, 14 of the bow 10. A plurality of separate openings are formed through the first cam portion 44 and are preferably in two series 52*a*–*d* and 53*a*–*e* radially spaced from the axle 24. The openings 52*a*–*d*, 53*a*–*e* are constructed to receive a cap screw 55 or other fastener to, as set forth further herein, locate and releasably position the draw stop arm 34 relative to the first cam portion 44. As best shown in FIG. 3, the back side 54 of the first portion 44 of the cam 20 is significantly cut away to reduce the weight of the cam 20 and define in part a take-up or intermediate portion 56 of the cam 20.

The take-up or intermediate portion 56 of the cam 20 has a second peripheral groove or track 58 adapted to receive the harness string 26 of the bow 10 as the drawstring 32 is drawn. The harness string 26 is initially received in only a small portion of the second track 58 adjacent to the hook-up post 50 on the first portion 44 of the cam 20 when the bow 10 is in its at rest position. As the drawstring 32 is drawn and the cam 20 rotates about the axle 24, the second track 58 of the intermediate portion 56 increasingly engages the harness string 26 to reduce the effective length of the harness string 26 and thereby decrease the distance between the free ends of the limbs 12, 14 to flex the limbs 12, 14 and store energy therein.

The intermediate portion 56 may also have sections or portions removed to reduce the weight of the cam 20. One or more hook-up posts 62 are formed on the front side of the intermediate portion 56 and are constructed to receive and retain one end of the drawstring 32 looped thereon. If more than one hook-up post 62 is provided, the drawstring 32 may be hooked to any one of the posts 62 to change the effective length of the drawstring 32. One or more hook-up posts 66 are also formed on the back side of the intermediate portion 56 as shown in FIG. 3. Each hook-up post 66 is constructed to receive and retain the other end of the drawstring 32 which cooperates with and is received within the track 42 of the first portion 44 of the cam body 40. Again, a plurality of hook-up posts 66 may be provided to change the location on the cam body 40 where the drawstring 32 is attached to change the effective length of the drawstring 32. The intermediate portion 56 has a recess 70 to receive the adjustable draw cam 36. A plurality of holes 72*a–e* are provided in the area of the recess 70 to receive a cap screw 55 or other fastener to releasably mount the draw cam 36 on the cam 20. A substantial portion of the front side of the intermediate portion 56 is cut away or otherwise removed to define an upper portion 74 of the cam body 40.

The upper portion 74 of the cam body 40 is thin to reduce the weight of the cam 20, is generally arcuate, and has a third peripheral track 76 adapted to receive a portion of the drawstring 32. The drawstring 32 is wrapped or trained around the upper portion 74 in the third track 76 when the bow 10 is in its at rest position. As the drawstring 32 is drawn, it is increasingly removed or unwrapped from third track 76 as the cam 20 rotates about the axle 24. A hole 78 formed through the upper portion 74 adjacent one end of the third track 76 receives the axle 24 therethrough. Other holes 80 through the upper portion 74 are formed to reduce the weight of the cam 20 in general.

Thus, the first cam portion 44, intermediate portion 56 and upper portion 74 of the cam body 40 are preferably integrally formed or machined from a single block of material. Each portion 44, 56, 74 has a contoured track 42, 58, 76 formed in its periphery to communicate with either the drawstring 32 or the harness string 26 of the bow 10 to efficiently store and release energy from the bow 10 and to provide efficient, repeatable and accurate performance of the bow 10 in use.

As best shown in FIG. 2, pair of adjustment members are provided on the cam body. The first adjustment member being the elongated draw stop arm 34 pivotal about the axle 24 extending through the cam body 40 and mounting the cam 20 on the limb 14. The second adjustment member being the draw cam 36 mounted on the first portion 44 of the cam body 40. The draw stop arm 34 or draw cam 36 can be used individually. Both of them preferably have a groove or track formed therein, each adapted to receive a portion of the harness string 26 during the draw of the bow 10 in cooperation with the second track 58 of the intermediate portion 56 of the cam 20.

Figure 6:
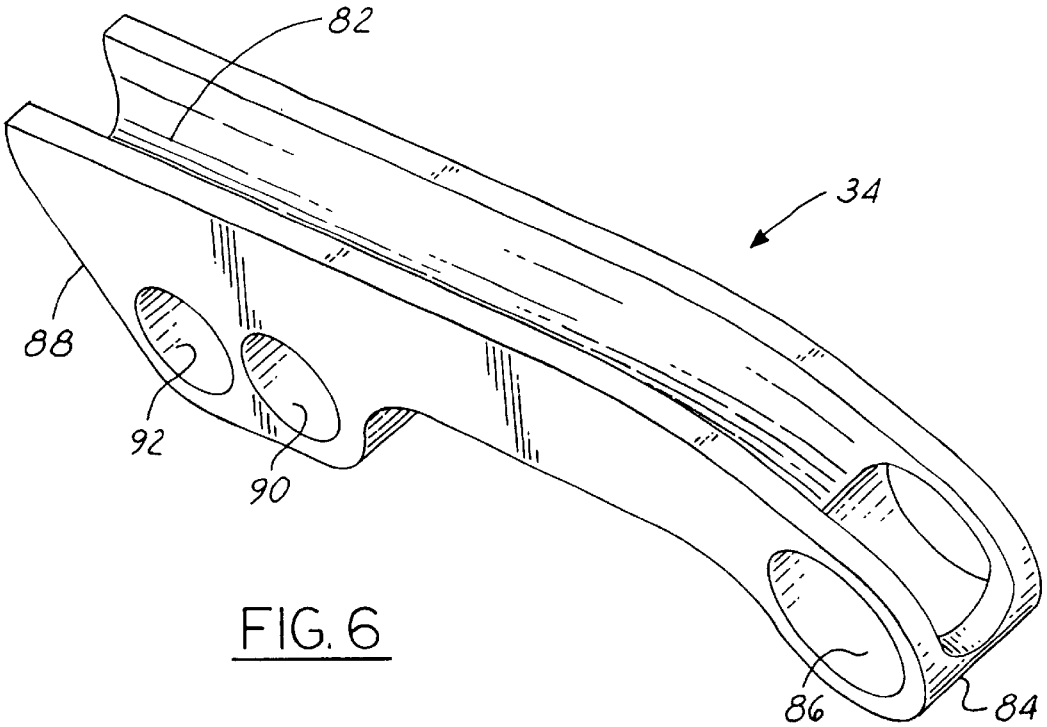
FIG. 6 is a perspective view of a draw stop arm removed from the cam.

As best shown in FIGS. 2, 4 and 6, the draw stop arm 34 is preferably elongated with a groove 82 formed along one side to receive the harness string 26 in cooperation with the draw cam 36 and second track 58. The harness string 26 engages substantially the entire groove 82 in the draw stop arm 34 and the engagement of the harness string 26 with the draw stop arm 34 limits the maximum draw length of the drawstring 32 or bow 10. Desirably, to provide a steadier and more controlled stop to the draw, the groove 82 is generally arcuate having a slight radius so that the harness string 26 more gradually engages the draw stop arm 34, first near one end 84 adjacent to the axle 24 and thereafter increasingly engaging the draw stop arm 34 further from the axle 24 until the harness string 26 is received within substantially the entire groove 82 preventing further rotation of the cam 20 to limit the draw of the drawstring 32. Alternatively, the groove 82 may be generally flat to provide a less gradual engagement of the harness string 26 and groove 82 to limit the draw of the drawstring 32. The draw stop arm 34 extends from the axle 24 a distance of less than 2 inches and preferably between 1–1.75 inches.

The draw stop arm 34 has a first hole 86 therethrough which receives the axle 24 mounting the cam 20 onto the limb 14 such that the draw stop arm 34 pivots about the axle 24 when it is adjusted. Alternatively, the draw stop arm 34 may be constructed to abut and be held against the axle 24 such as by a recess at end 84 generally complementary to the axle. At the other end 88 of the draw stop arm 34, one or more openings 90, 92 may be formed with each opening 90, 92 communicating with the openings 52*a–d*, 53*a–e* extending through the cam 20 to vary the angular position of the draw stop arm 34 on the cam body 40 in desired increments. When an opening 90 or 92 on the draw stop arm 34 is aligned with a corresponding opening 52*a–d* or 53*a–e* on the cam body 40, a cap screw 55 may be inserted through the openings (90 and one of 52*a–d* or 92 and one of 53*a–e*) to releasably retain the position of the draw stop arm 34.

Figure 5:
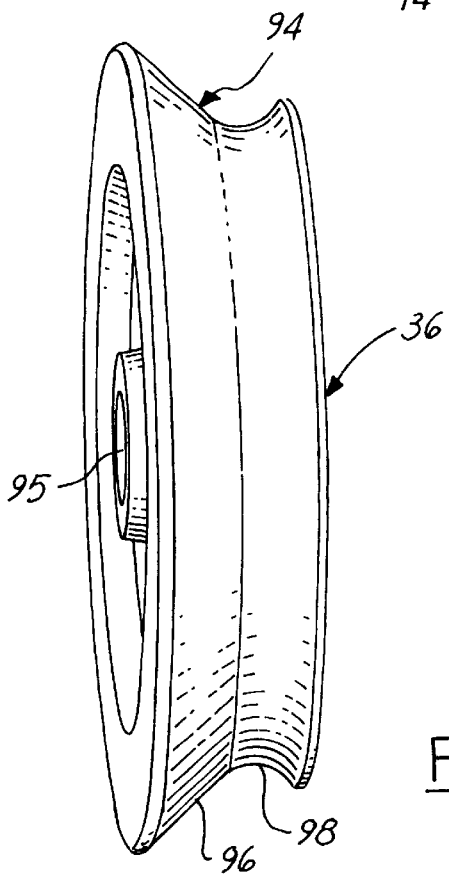
FIG. 5 is a perspective view of a first embodiment of a draw cam removed from the cam.

As shown in FIGS. 2 and 5, the draw cam 36 may have a generally circular perimeter with a groove 94 formed therein as shown, and may be mounted about its axis or eccentrically as desired. Alternatively, the draw cam 36 may have an irregular shape with a contoured track or groove adapted to receive the harness string 26 during the draw of the bow 10. The draw cam 36 is preferably mounted to the cam body 40 by a cap screw 97 received through a bore 95 through the draw cam 36 and one of the plurality of holes 72*a–e* in the cam body 40. This mounting arrangement enables the position of the draw cam 36 relative to the intermediate portion 56 to vary and correspondingly vary the engagement of the draw cam 36 with the harness string 26 as the drawstring 32 is drawn. As shown in FIG. 5, the draw cam groove 94 is preferably tapered or generally frustoconical along one side 96. The side 96 may be tapered at an acute included angle of between 20 and 80 degrees. This tapered side 96 provides a smoother engagement of the harness string 26 with the draw cam 36 by gradually centering the harness string 26 in a bottom 98 of the groove 94 if the harness string 26 is slightly misaligned and initially engages the tapered side 96. Desirably, this reduces friction on the harness string 26 to reduce "thumping" of the string and provide a smoother draw of the bow 10 for the user. This also greatly reduces wear on the harness string 26 to extend its useful life.

The draw stop aim 34 and draw cam 36 may be integrally formed and hinged or rotatable about the axle 24 to vary their position relative to the cam 20 as desired. The draw stop arm 34 and draw cam 36 can be individually adjusted to corresponding positions on the cam body 40 to change the draw length and let-off position and magnitude while still providing the optimum feel and consistency of the draw of the bow 10. Both the draw stop arm 34 and draw cam 36 may be separately adjusted. However, this will have some affect on the draw length of the bow 10 and may provide a less gradual or less smooth draw stop or limit the draw in certain positions. Desirably, when the bow is in its at rest position, no harness string 26 or drawstring 32 acts on or bears on either the draw stop arm 34 or draw cam 36 such that both may be readily adjusted without disassembling the bow 10.

The groove 94 of the draw cam 36 extends along a predetermined radius between about 0.3 and 0.5 inches, nominally 0.40 inches, which provides the desirable break-over radius of the cam 20 to control the let-off near the maximum draw length of the bow 10. The radius of the draw cam 36 groove remains constant so that even if the draw cam 36 is moved to different positions on the cam 20, the initiation of the let-off will have essentially the same feel even though the position or location of the let-off during the draw changes as the draw cam 36 is moved to different positions on the cam 20. A larger radius will initiate let-off more slowly and a smaller radius will initiate let-off more quickly. If an irregularly shaped or non-circular draw cam 36 is provided, it may be possible to change the feel of the initiation of the let-off. As the irregularly shaped draw cam 36 is moved relative to the cam 20, the portion of the draw cam 36 that defines the break over radius may be changed. A differently shaped break over radius can change the magnitude of the let-off. Desirably, the draw cam 36 can be moved to different positions along an are or radius so that the break over radius portion of the draw cam 36 is at a constant radius relative to the axle 24 to provide consistent performance of the bow 10 when the draw cam 36 is in any of its various positions. Nominally, the radius is less than 1.75 inches and preferably about 1.4 inches in all positions of the draw cam 36.

The draw length of the bow 10 is stopped or limited when the harness string 26 is received in substantially the entire groove 82 of the draw stop arm 34. The further the cam 20 has to rotate until the harness string 26 engages the free end 88 of the draw stop arm 34, the greater the draw length of the bow 10. In some positions, almost the entire length of the track may be engaged all at once or nearly so. Desirably, the draw stop arm 34 may be moved in a plurality of angular positions relative to the cam 20 to change the point in the rotation of the cam 20 wherein the harness string 26 fully engages the draw stop arm 34. Each position corresponds to a different maximum draw length of the bow 10 and may vary the draw length by substantially any increment from about 1/16 of an inch up to 1 inch increments or greater. Alternatively, the draw stop arm 34 may take any shape other than an elongated arm which is suitable to engage at least a ¼ inch length of the harness string 26 to provide a positive, non-spongy stop or limit to the draw length of the bow 10. Further, the draw stop arm 34 may comprise more than one body, each adjustable on the cam body 40 and that cooperate to engage the harness string 26 along a desired length. In whatever form, the draw stop arm 34 engages at least ¼ of an inch of the harness string 26 at full draw, desirably, at least ½ of an inch and, preferably, between about ½ of an inch to 2 inches.

In the embodiment of FIGS. 1–6, the first series of openings 52*a–d* comprises four holes corresponding to four different positions of the draw stop arm 34 and the second series of openings 53*a–e* comprises five holes corresponding to another five positions of the draw stop arm 34. Thus, the draw stop arm 34 may be disposed in nine different positions corresponding to nine different draw lengths of the bow 10. By changing the location of the openings 52*a–d*, 53*a–e*, or by providing other openings, nearly any increment of change of the draw length can be achieved. Therefore, a single cam assembly can be used to provide a wide range of draw lengths for the bow 10 without having to change the cam 20 or to change or replace differently shaped modules on the cam 20.

Still further, the position of the draw cam 36 also affects the draw length of the bow 10 by changing the amount of rotation of the cam 20 until the draw stop arm 36 engages the harness string 26. When the draw cam 36 is mounted via hole 72*e*, the draw length will be significantly greater than when it is mounted via hole 72*a* for a similar draw stop arm 34 position.

As shown, the cam 20 has forty-five different possible settings due to the five possible draw cam 36 positions and nine possible draw stop arm 34 positions. Within the possible settings of the exemplary cam, the draw length can be changed by four inches and the magnitude of the let-off can be changed between over 80% and less than 40% as desired. These ranges are exemplary only and a cam 20 can be designed with a wide range of possible draw lengths and let-offs.

In general, the magnitude of the let-off when the bow 10 is fully drawn is at least in part a function of the effective distance of the draw stop arm 34 from the axle 24. Additionally, the position of the draw cam 36 and its portion defining the break over radius also affects the magnitude of the let-off. Notably, the draw cam 36 rotational distance between the break over radius, where the let-off is initiated, and the draw stop arm 34, greatly affects the magnitude of the let-off. The greater the rotational distance from the initiation of the let-off to the end of the draw, the greater the magnitude of the let-off and vice versa.

Figure 8:
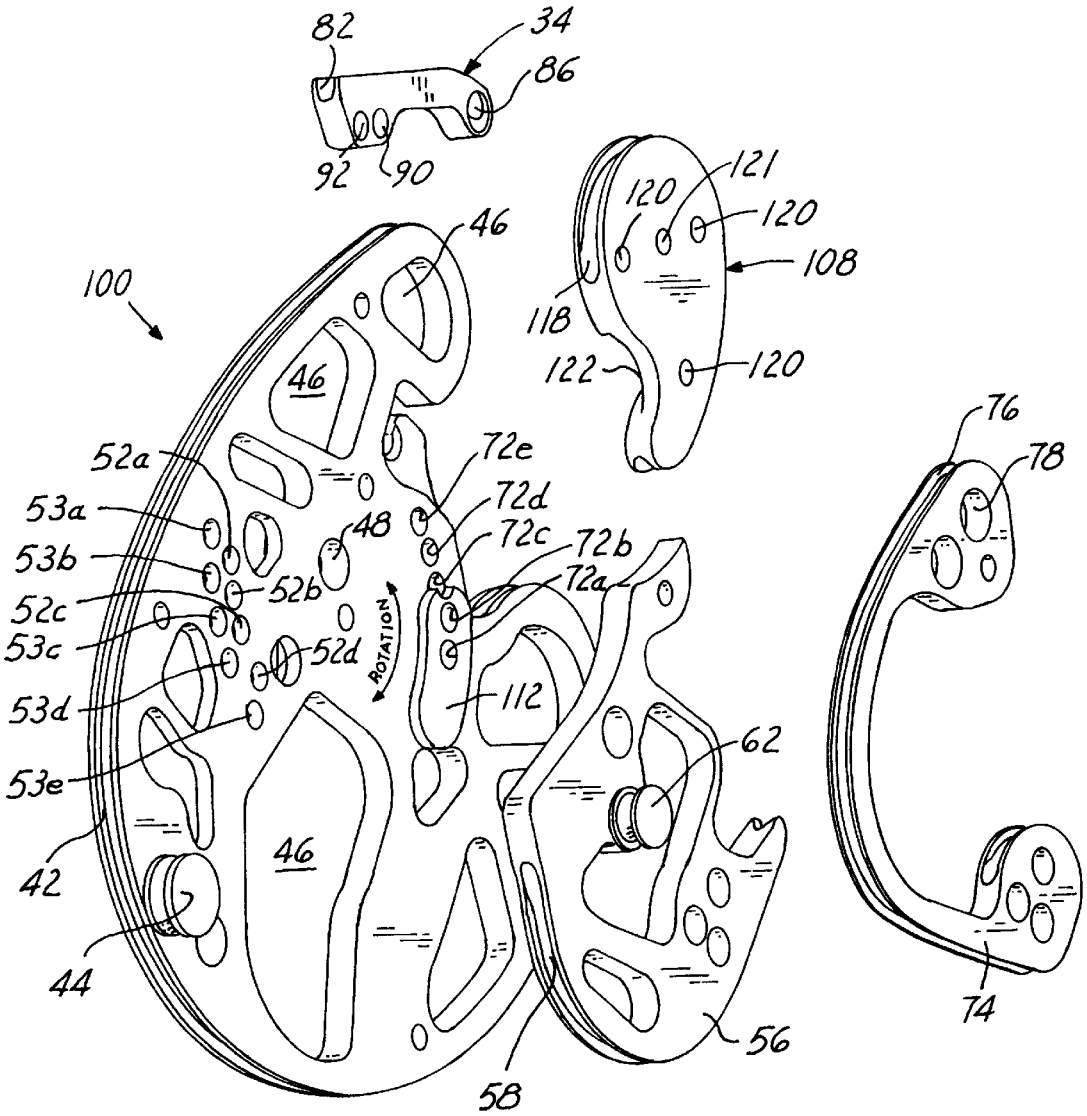
FIG. 8 is an exploded view of a second embodiment of a cam, the draw cam and draw stop arm.

A second embodiment of a cam 100 is shown in FIGS. 8–11 which also has a first cam portion 102, an intermediate portion 56 and an upper portion 74 all preferably integrally formed from a single block or body 107 of material even though they are shown in FIG. 8 in an exploded fashion for case of viewing. The intermediate portion 56 and upper portion 74 are substantially the same as in the first embodiment cam 20 and hence will not be described further. Additionally, the draw stop arm 34 and majority of the first cam portion 102 of the cam 100 are identical to that of the first embodiment cam 20. The draw cam 108 and its associated section of the first cam portion 102 of the cam 100 are of a different construction than that of the first embodiment cam 20 and will be described in more detail below.

Figure 10:
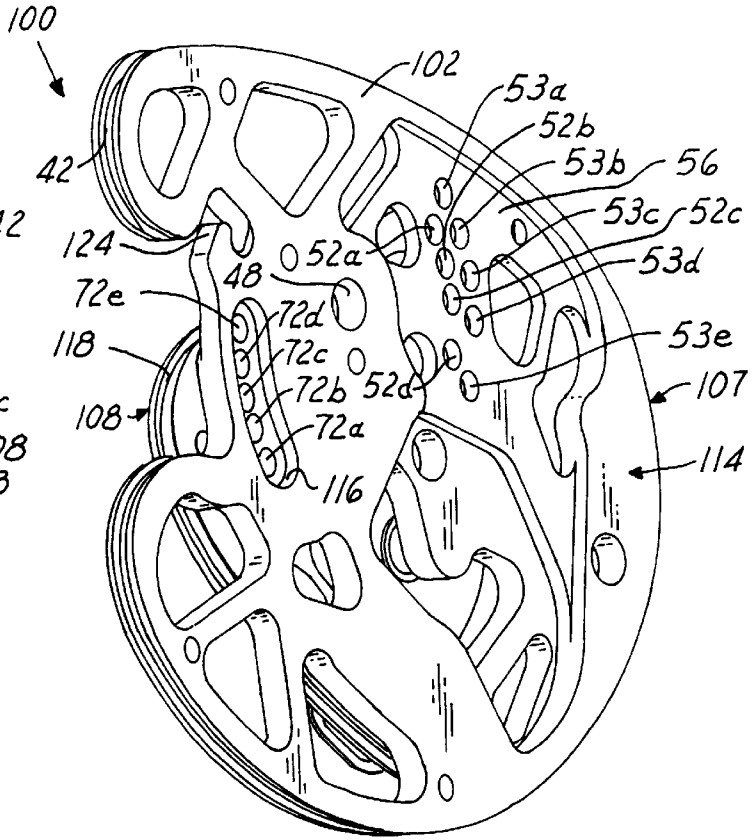
FIG. 10 is a perspective view of the cam of FIG. 8 illustrating a rear face of the cam.
Figure 9:
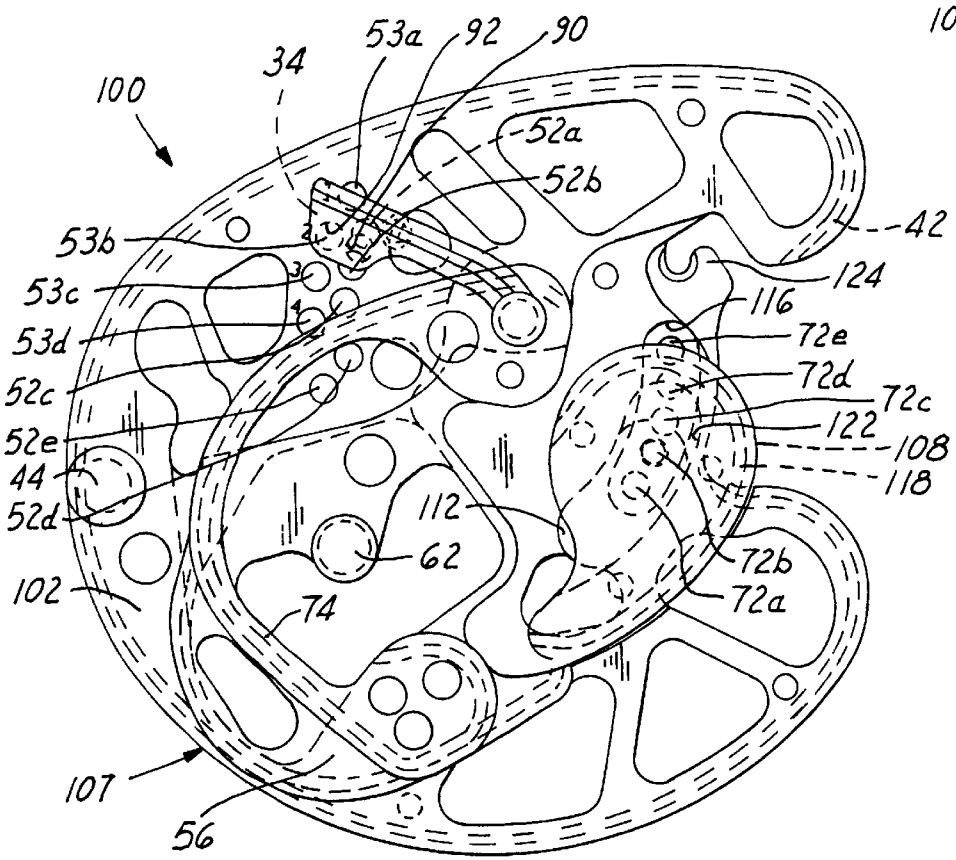
FIG. 9 is a front view of the cam of FIG. 8.

As in the first embodiment cam 20 and as shown in FIGS. 8–11, the first cam portion 102 of the cam 100 of the second embodiment has a plurality of holes 72*a–e* spaced from one another, each constructed to receive a fastener to mount the draw cam 108 onto the first cam portion 102 and each corresponding to a different position or location of the draw cam 108 on the cam 100. The first cam portion 102 of the cam 100 has a raised, contoured boss 112 that cooperates with the draw cam 108 to accurately position the draw cam 108 relative to the cam 100 in each of its various positions to ensure the maximum, efficient performance of the bow 10. As shown in FIG. 10, a portion of the rear face 114 of the first portion 102 of the cam body 107 has a recess 116 in the area surrounding and including the holes 72*a–e* for mounting the draw cam 108 so that the fastener used to mount the draw cam 108 does not extend beyond the rear face 114 of the first portion of the cam body 107.

The draw cam 108 is not circular, but rather has an irregular, contoured profile with a groove or track 118 formed in a substantial portion of its periphery and adapted to receive the harness string 26 as the bow 10 is drawn. The contoured periphery, and hence, the contoured track 118, engages the harness string 26 in a predetermined manner to provide more efficient operation of the bow 10. A plurality of holes 120 may be formed through the draw cam 108 either to reduce its weight or to facilitate mounting the draw cam 108 onto the cam body 107. At least one hole 121 aligns with the series of holes 72*a–e* through the first portion of the cam body 107 to permit the draw cam 108 to be mounted in the various positions corresponding to the location of the holes 72*a–e*. A recess 122 corresponding to the general shape of the boss 112 is formed in the draw cam 108 and is constructed to slidably receive the boss 112 to accurately position the draw cam 108 on the cam body 107 to ensure optimum performance of the bow 10 when the draw cam 108 is in any of its various positions corresponding to the holes 72*a–e*. As an alternative, the location of the boss 112 and recess 122 may be reversed, with the draw cam 108 having a boss 112 thereon to be guided for slidable movement relative to the cam body 107 in a complementary recess 122 in the cam body 107.

Desirably, the boss 112 and series of holes 72*a–e* position the draw cam 108 such that the distance from the bottom of its track 118 to the axle 24 which mounts the cam 100 onto the limb 12 ofthe bow 10 is constant in any of the positions of the draw cam 108. Nominally, this distance is less than 1.75 inches and preferably about 1.4 inches. This provides a consistent mechanical advantage upon engagement with the harness string 26 during the draw of the bow 10 in any position of the draw cam 108 so that the energy stored in the limbs 12, 14 provides a consistent and efficient performance of the bow 10. Each hole 72*a–c* on the cam body 107 corresponds to a different draw length of the bow 10 with a first hole 72*a* defining a shorter draw length and the last hole 72*e* defining a maximum draw length as controlled by the position of the draw cam 108. Notably, the position of the draw stop arm 34 also effects draw length such that a wide range of draw lengths can be achieved. A maximum draw length of the bow 10 is achieved when the draw stop arm 34 is in its position corresponding to the maximum draw length and the draw cam 108 is also in its position corresponding to the maximum draw length.

Instead of a post or anchor, the end of the drawstring adjacent to the track 42 in the first cam portion 102 may be hooked or connected to a finger 124 extending from the cam body 107 spaced from and extending generally perpendicular to the immediately adjacent portion of the groove 42.

In any event, the second embodiment cam 100 functions substantially the same as the first embodiment cam 20 with the intermediate portion 56 of the cam body 107 initially rotated into engagement with the harness string 26 upon drawing of the bow 10. Upon further drawing of the bow 10, the draw cam 108 is rotated into engagement with the harness string 26 until the draw stop arm 34 is rotated into engagement with the harness string 26 to prevent further drawing of the bow 10. Desirably, when the bow 10 is in its at rest position, there is no string acting or bearing on the draw stop arm 34 or the draw cam 108 such that they can be readily adjusted without disassembling the bow 10, as in the first embodiment cam 20.

For one exemplary embodiment of the invention constructed generally as shown and described herein, the draw length, maximum draw weight or force, and magnitude of the let-off were empirically determined for all forty-five positions of the draw stop arm 34 and draw cam 108 as shown in the following table.

| Draw Cam location | Draw Stop Arm location | Draw Length (in) | Draw Weight (lbs) | % LetOFF |
|---|---|---|---|---|
| 72a | 53a | 26¾ | 70 | 78.10% |
| 72a | 53b | 27½ | 70 | 81.10% |
| 72a | 53c | 28⅛ | 70 | 78.40% |
| 72a | 53d | 28⅞ | 70 | 79.50% |
| 72a | 53e | 29⅞ | 70 | 74.50% |
| 72a | 52a | 27⅛ | 70 | 79.70% |
| 72a | 52b | 27⅞ | 70 | 80.20% |
| 72a | 52c | 28½ | 70 | 78.70% |
| 72a | 52d | 29½ | 70 | 78.10% |
| 72b | 53a | 27½ | 70 | 67.70% |
| 72b | 53b | 27⅞ | 70 | 78.50% |
| 72b | 53c | 28½ | 70 | 79.10% |
| 72b | 53d | 29⅛ | 70 | 79.10% |
| 72b | 53e | 30⅛ | 70 | 75.40% |
| 72b | 52a | 27⅝ | 70 | 73.70% |
| 72b | 52b | 28¼ | 70 | 80.10% |
| 72b | 52c | 28⅞ | 70 | 79.50% |
| 72b | 52d | 29⅞ | 70 | 77.40% |
| 72c | 53a | 28 | 70 | 58.10% |
| 72c | 53b | 28⅜ | 70 | 68.80% |
| 72c | 53c | 28¾ | 70 | 77.80% |
| 72c | 53d | 29¼ | 70 | 78.80% |
| 72c | 53e | 30¼ | 70 | 74.00% |
| 72c | 52a | 28⅛ | 70 | 63.10% |
| 72c | 52b | 28½ | 70 | 74.20% |
| 72c | 52c | 29⅛ | 70 | 79.10% |
| 72c | 52d | 30⅛ | 70 | 77.70% |
| 72d | 53a | 28½ | 70 | 48.70% |
| 72d | 53b | 28⅞ | 70 | 58.40% |
| 72d | 53c | 29¼ | 70 | 67.00% |
| 72d | 53d | 29¾ | 70 | 77.00% |
| 72d | 53e | 30¾ | 70 | 75.20% |
| 72d | 52a | 25⅝ | 70 | 53.70% |
| 72d | 52b | 29 | 70 | 63.10% |
| 72d | 52c | 29⅜ | 70 | 71.50% |
| 72d | 52d | 29½ | 70 | 71.80% |
| 72e | 53a | 28⅞ | 70 | 39.50% |
| 72e | 53b | 29¼ | 70 | 45.20% |
| 72e | 53c | 29¾ | 70 | 52.20% |
| 72e | 53d | 30⅛ | 70 | 63.70% |
| 72e | 53e | 30¾ | 70 | 74.80% |
| 72e | 52a | 29⅛ | 70 | 43.80% |
| 72e | 52b | 29½ | 70 | 50.80% |
| 72e | 52c | 30 | 70 | 58.40% |
| 72e | 52d | 30⅝ | 70 | 73.10% |

Figure 12:
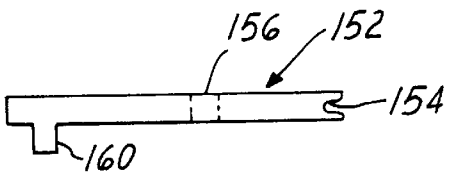
FIG. 12 is an end view of the draw cam of FIG. 11.
Figure 11:
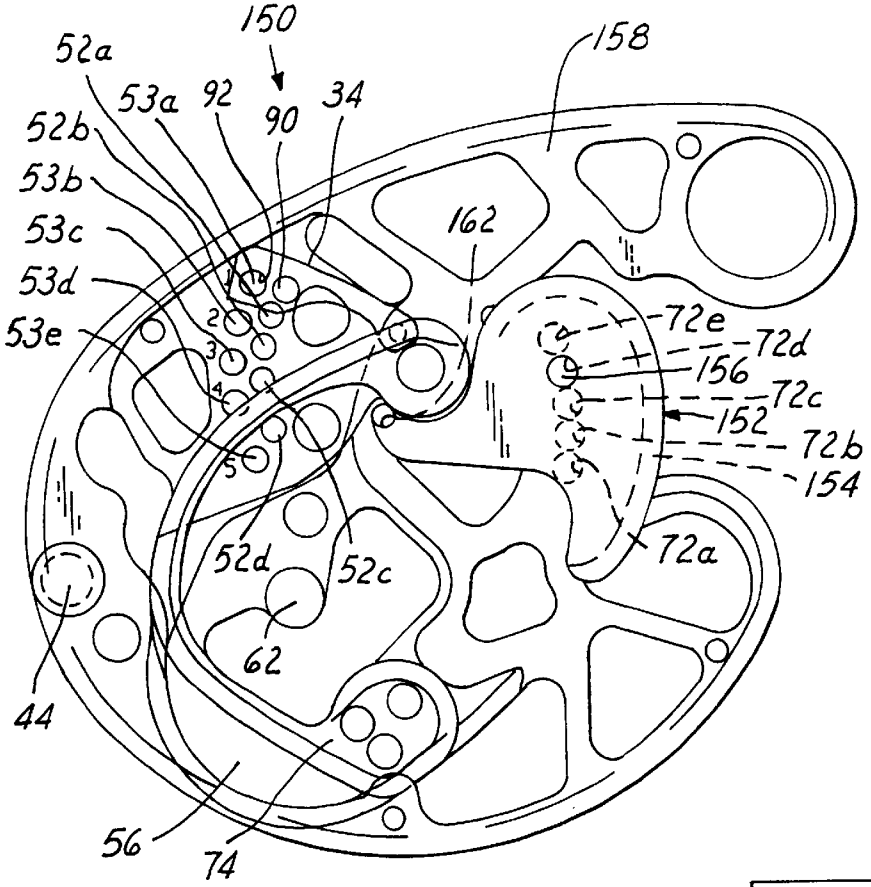
FIG. 11 is a front view of a third embodiment of a cam with a modified draw cam.

From this data, it is clear that a wide range of draw lengths and let-off magnitudes can be achieved by a user with a single bow 10 having a cam 100 as described. Desirably, the maximum draw force remains essentially constant in all positions to maintain a consistent storage of energy and release of energy from the bow FIGS. 11–12 illustrate a third embodiment of a cam 150 having a modified draw cam 152 and draw stop arm 153 mounted thereon. The draw stop arm 153 is adjustably connected at both ends to the cam 150 such as by fasteners extending through an opening 153*a* in one end 153*b* of the draw stop aim 153 and received in the cam 150 rather than receiving or pivoting about the axle 24. In any event, the draw stop arm 153 functions in substantially the same manner as the draw stop arm 34. The remainder of the third embodiment cam 150 is identical to the previous two embodiments of the cam 20, 100 except as described below.

The draw cam 152 has an irregular, contoured profile with a groove or track 154 formed in a substantial portion of its periphery to receive the harness string 26 upon drawing of the bow 10 as in the other embodiments. The draw cam 152 has a hole 156 therethrough selectively aligned with each of the plurality of holes 72*a–e* through the first portion 158 of the cam 150 to receive a fastener and releasably secure the draw cam 152 in any of the various positions corresponding to the location of the holes 72*a–e*. As shown in FIG. 12, the draw cam 152 has a depending finger 160 that is received in a bore 162 in the first portion 158 of the cam 150 to properly position the draw cam 152 on the cam 150. The draw cam 152 pivots about the finger 160 to accurately position the draw cam 152 on the cam 150 in any of its various positions corresponding to the holes 72*a–e*.

Desirably, the pivoting of the draw cam 152 about the finger 160 maintains a generally consistent distance of the track 154 of the draw cam 152 relative to the axle 24 to maintain a consistent performance of the bow 10 when the draw cam 152 is in any of its various positions. Desirably, this distance is less than 1.75 inches and is preferably about 1.4 inches. Also, the draw cam 152 preferably has a break over radius of about 0.4 inches as in the previous embodiments. The third embodiment cam 150 functions in the same manner as the previous embodiment in use of the bow 10 with both the draw stop arm 153 and the draw cam 152 being independently adjustable to affect the draw length of the bow 10, the location of the let-off point and the magnitude of the let-off in the draw.

Figure 13:
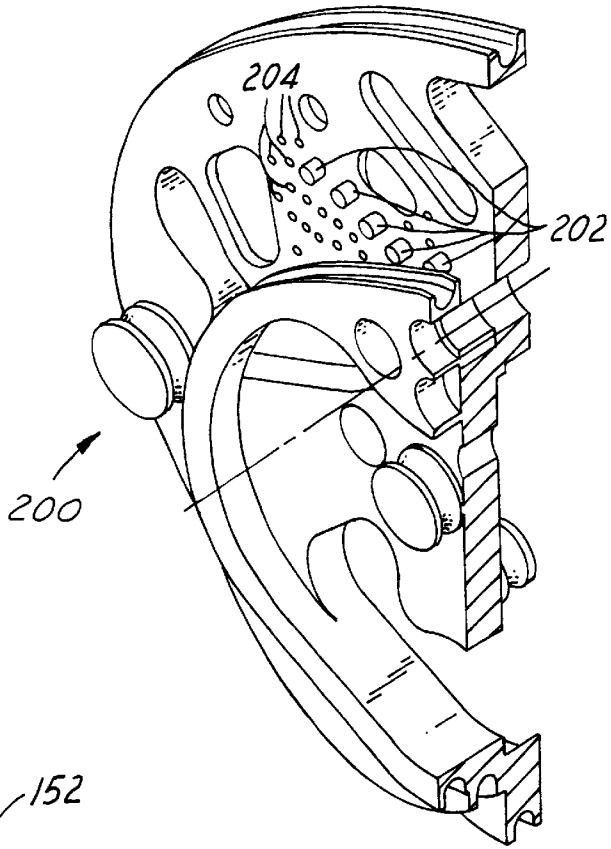
FIG. 13 is a sectional view of a cam showing an alternate embodiment draw stop arm.

FIG. 13 illustrates a fourth embodiment cam 200 which has a plurality of draw stop bodies 202, each adjustably carried on the cam 200 via a threaded end (not shown) received in one of a plurality of holes 204 in the cam 200. The bodies 202 may be arranged to engage a certain length of the harness string 26 at the maximum draw length. Desirably, the bodies engage at least ¼ of an inch of the harness string 26 and preferably, between ½ and 2 inches to provide a controlled, steady limit to the draw. Alternatively, the bodies 202 may be slidably adjustable in elongated or arcuate slots in the body. Further, while shown as a plurality of pegs or the like, the bodies 202 may be elongated with two or more disposed on the cam 200. In any form, the bodies 202 function in the same general manner as the draw stop arm 34 to provide a controlled, efficient and adjustable limit to the draw of the bow 10.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

What is claimed is:

1. A cam for a compound archery bow, comprising:

a cam body having at least one groove for receiving a bowstring;

a first adjustment member carried by the cam body, said first adjustment member engaging a bowstring during at least a portion of the draw of the bow and movable between at least two positions to alter its engagement with the bowstring and thereby alter the let-off characteristics and the maximum draw length of the bow; and a second adjustment member carried by the cam body, said second adjustment member engaging a bowstring during at least a portion of the draw of the bow and movable between at least two positions to alter its engagement with the bowstring and thereby alter the let-off characteristics and the maximum draw length of the bow.

2. The cam of claim 1 wherein the first adjustment element comprises an arm having a first end and a second end, said arm releasably attachable to the cam body in a plurality of positions to vary the orientation of the arm relative to the cam body.

3. The cam of claim 2 which also comprises an axle hole through the cam body adapted to receive an axle of the bow and an axle opening through the arm adapted to receive the axle of the bow and to permit the arm to pivot about the axle.

4. The cam of claim 3 which also comprises at least two spaced apart openings in the cam body and at least one corresponding hole in the arm adapted to communicate with a different one of the openings in the cam body in each position of the arm.

5. The cam of claim 4 wherein the axle opening of the arm is adjacent to the first end and said corresponding hole in the arm is generally adjacent to the second end of the arm and the openings in the cam body are generally equally radially spaced from the axle hole of the cam body.

6. The cam of claim 4 wherein the openings in the cam body are spaced apart from each other a distance corresponding to a difference in draw length of the bow of at least 1/16 of an inch.

7. The cam of claim 4 wherein the openings in the cam body are spaced apart from each other a distance corresponding to a difference in draw length of the bow of at least ¼ of an inch.

8. The cam of claim 2 wherein the arm has a groove formed therein extending between its ends and defining a track adapted to receive a bowstring during a portion of the draw of the bow.

9. The cam of claim 8 wherein the track is generally arcuate.

10. The cam of claim 8 wherein the arm is carried on the cam body such that during a draw of the bow, the bowstring initially engages the arm at a location spaced from its second end and thereafter, engagement of the bowstring with the second end of the arm prevents further drawing of the bow to limit the maximum draw length of the bow.

11. The cam of claim 8 wherein the second adjustment member is a separate cam having a non-circular periphery.

12. The cam of claim 1 wherein the second adjustment member is a draw cam having a generally circular perimeter.

13. The cam of claim 12 wherein the second adjustment member is mounted about its axis on the cam body.

14. The cam of claim 12 wherein the second adjustment member is eccentrically mounted on the cam body.

15. The cam of claim 1 which also comprises a boss on one of the cam body and the second adjustment member, said boss constructed to position at least in part the second adjustment member on the cam body.

16. The cam of claim 15 wherein the boss is contoured to position the second adjustment member a substantially uniform distance from an axle hole of the cam body which is adapted to receive an axle which mounts the cam onto a bow.

17. The cam of claim 15 wherein one of the cam body and second adjustment member has a recess complementarily shaped to the boss to receive at least a portion of the boss therein when assembled.

18. The cam of claim 1 wherein the second adjustment member has a finger adapted to be received in a bore of the cam body to permit pivotal movement about the finger of the second adjustment member relative to the cam body between its various positions.

19. The cam of claim 1 wherein the second adjustment member defines a break over radius of between 0.5 to 0.3 of an inch.

20. The cam of claim 19 wherein the break over radius is 0.4 of an inch.

21. The cam of claim 1 wherein the second adjustment member is adapted to be movable between its various positions with an effective radius of the second adjustment member from the axle of less than 1.75 inches in every position of the second adjustment member.

22. The cam of claim 21 wherein the radius is 1.4 inches in every position of the second adjustment member.

23. The cam of claim 1 wherein the cam has at least one series of openings with each of said openings adapted to receive a fastener mounting the first adjustment member on the cam, and the cam has at least one second series of openings with each of said second series adapted to receive another fastener releasably mounting the second adjustment member on the cam with the first adjustment member being movable and mountable on the cam independently of the second adjustment member.

24. The cam of claim 1 wherein the cam body has a hole adapted to receive an axle of the bow and the first adjustment member is a draw stop arm positioned within a radius of 1.75 inches from said axle hole.

25. A cam for a compound archery bow, comprising:

a cam body having at least one groove constructed to receive a string of the bow and an axle hole adapted to receive an axle of the bow; and a draw stop carried by the bow in a plurality of positions relative to the axle hole and constructed to engage a string of the bow over a length of the string of at least ¼ of an inch to limit the draw length of the bow and being adjustable between its various positions independently of the position of a break over radius of the bow which initiates the let-off in the draw.

26. The cam of claim 25 wherein the draw stop engages the bowstring over a length of at least ½ of an inch.

27. The cam of claim 25 wherein the draw stop has a pair of ends and at one end the draw stop is adapted to pivot about the axle of the bow and at its other end the draw stop is releasably connected to the cam body in each of its various positions.

28. The cam of claim 27 wherein the draw stop has an opening therethrough which in assembly is aligned with the axle hole and is adapted to receive the axle of the bow.

29. The cam of claim 25 wherein the draw stop has a pair of ends and is releasably connected to the cam body at both ends in each of its various positions.

30. The cam of claim 25 wherein the draw stop is independently adjustable on the cam body.

31. The cam of claim 25 wherein the draw stop is an elongated arm having a track constructed to receive the string of the bow during a portion of the draw of the bow.

32. The cam of claim 25 wherein the draw stop has a non-linear profile engageable with the string of the bow.

33. A cam for an archery bow, comprising:

a cam body having at least one groove for receiving a bowstring;

a draw cam carried by said cam body, said draw cam engaging a bowstring during at least a portion of the draw of the bow and moveable between at least two positions to alter its engagement with the bowstring and thereby alter the let-off characteristics and maximum draw length of the bow;

a boss on one of the cam body and the draw cam, said boss constructed to position at least in part the draw cam on the cam body.

34. The cam of claim 33 wherein said boss has an arcuate shape that cooperates with said cam body to position said draw cam on said cam body at a substantially uniform distance from an axle hole of the cam body, the axle hole receiving an axle that mounts the cam body onto the archery bow.

35. The cam of claim 34 wherein one of the cam body and the draw cam has a recess, said recess complementarily shaped to the boss whereby said recess receives at least a portion of the boss therein when said draw stop is carried by said cam body.

36. The cam of claim 35 wherein the draw cam has an irregular, contoured peripheral profile, said peripheral profile having a track formed therein.

37. The cam of claim 35 wherein the draw cam includes a least one hole therein to facilitate mounting said draw cam to said cam body, and said cam body including a plurality of holes therein, said hole in said draw cam cooperating with one of said holes in said cam body to permit the draw cam to be mounted at various positions on said cam body.

38. The cam of claim 33 wherein the draw cam is movable between various positions with an effective radius of the draw cam from the axle of less than 1.75 inches in every position of the draw cam.

39. The cam of claim 33 wherein the draw cam is independently adjustable on the cam body.

40. A cam for a compound archery bow, comprising:

a cam body having at least one groove for receiving a bowstring;

a draw cam carried by said cam body, said draw cam engaging a bowstring during at least a portion of the draw of the bow and moveable between at least two positions to alter its engagement with the bowstring and thereby alter the let-off characteristics and maximum draw length of the bow; and a finger depending from said draw cam, said finger received in a bore on the cam body such that the draw cam pivots about the finger to position the draw cam on the cam body.

41. The cam of claim 40 wherein the draw cam includes at least one hole therein to facilitate mounting said draw cam to said cam body, and said cam body including a plurality of holes therein, said hole in said draw cam cooperating with one of said holes in said cam body to permit the draw cam to be mounted at various positions on said cam body.

42. The cam of claim 40 wherein the draw cam has an irregular, contoured peripheral profile, said peripheral profile having a track formed therein.

43. The cam of claim 40 wherein the draw cam is movable between various positions with an effective radius of the draw cam from the axle of less than 1.75 inches in every position of the draw cam.

44. The cam of claim 40 wherein the draw cam is independently adjustable on the cam body.

* * * * *